United States Patent [19]

Graham et al.

[11] Patent Number: 4,808,971

[45] Date of Patent: Feb. 28, 1989

[54] ALARM APPARATUS

[75] Inventors: Randall C. Graham, Nashville, Tenn.; James L. Phillips, Fort Wayne, Ind.

[73] Assignee: Essex Group, Inc., Fort Wayne, Ind.

[21] Appl. No.: 105,777

[22] Filed: Oct. 7, 1987

[51] Int. Cl.[4] ..... G08B 19/00

[52] U.S. Cl. ..... 340/521; 340/500; 340/523; 340/525; 340/692

[58] Field of Search ..... 340/521, 525, 500, 506, 340/523, 692

[56] References Cited

U.S. PATENT DOCUMENTS

| | | | |
|---|---|---|---|
| 4,270,185 | 5/1981 | Cohen et al. | 340/525 |
| 4,294,066 | 10/1981 | Lane | 340/525 |
| 4,581,605 | 4/1986 | Vogt | 340/525 |
| 4,644,332 | 2/1987 | Graham | 340/624 |

*Primary Examiner*—Donnie L. Crosland
*Attorney, Agent, or Firm*—Francis J. Maguire, Jr.

[57] ABSTRACT

The fabrication of magnet wire in an "in-line" drawing-enameling process is monitored by a local operator control station having an alarm display format screen stored therein for operator call-up via a remote controller for displaying a plurality of alarmed parameters in a time ordered sequence. The local operator station includes a local signal processor, a keyboard, a display and an input/output port. The remote controller includes a remote signal processor, a digital input/output device, and a plurality of modular cassette tape players. The first to occur alarm is sensed and is verbally annunciated while, at the same time, the alarm signal is stored and time tagged. If one or more alarms subsequently occur, an operator may wish to determine the nature of these later occurring alarms and the exact sequence in which the alarms occurred. The operator simply calls up the alarm display format via the keyboard at the local station and a display is presented in which the alarms are displayed in the order in which they occurred. The remote controller is located in an out-of-the-way location so as to efficiently utilize floorspace while at the same time controlling a large number of parameters in one main controller unit.

1 Claim, 6 Drawing Sheets

OVEN212ALARM CONTROL

F1 FLAME OUT INCINERATOR
F2 FLAME OUT ZONE BURNER
F3 FAN PRESS SWITCH TRIP
F4 WIRE TANGLE AT BASKET
F5 WIRE BREAK OUT
F6 DRY LUBE LEVEL LOW
F7 WIRE RUN TOGETHER
F8 WIRE SLIVERS DETECTED

F12 DEACTIVATE ALARM SYSTEM
F13 BUZZER AND LIGHT
F14 SHOW FAULTS DETECTED

INSTRUCTIONS: PRESS F KEY TO TURN ALARM OFF AND AGAIN TO RESET TO STANDBY.

TO TEST ALARM PRESS TEST ALARM AND THEN F KEY.

TO END TEST PRESS EXIT TEST AND THEN F KEY.

TEST ALARM | EXIT SCRN

FIG.4

OVEN212ALARM SEQUENCE

INSTRUCTIONS: PRESS F1 TO DISPLAY FAULTS IN THE ORDER IN WHICH THEY OCCURRED.

PRESS F2 TO CLEAR FAULTS AND RESET FAULT DETECT SYSTEM.

1ST
2ND
3RD
4TH
5TH
6TH

FIRST SIX FAULTS TO OCCUR ARE DOWN HERE

SHOW FAULTS | CLEAR FAULTS | EXIT SCRN

FIG.5

ALARM APPARATUS

TECHNICAL FIELD

This invention relates to the manufacture of magnet wire and, more particularly, to apparatus for providing alarms for a magnet wire fabrication process.

BACKGROUND ART

As this invention relates to an apparatus for indicating alarms for a magnet wire fabrication process, it is necessary to understand the basics of the process in order to fully appreciate the need and desirability for such an apparatus.

Magnet wire is fabricated with an electrically insulating film (enamel) on metal wire. This wire's end use is in coils which produce electromagnetic fields as found in electric motors, transformers, relays, etc. It is extremely important that enamel film be cured to the proper degree to produce the optimum electrical and mechanical properties.

Much of today's magnet wire insulation is produced in two enamel coats. The base coat is formulated to give optimum electrical insulating properties and the top coat enhanced mechanical properties, such as a low coefficient of friction so that the wire will readily pass through high speed coil winding equipment without film damage.

The wire is produced at high speed and a fast response is therefore required upon detecting an abnormal condition in order to provide quick corrective action and thereby prevent production delays. Magnet wire factories usually consist of a large number of production units spread over a wide expanse and staffed by only by a small number of maintenance personnel on and around the clock basis. An alarming system can be provided for detecting faults and producing verbally annunciated alarms in time to provide sufficient information to immediately direct the maintenance personnel to the source of the problem to prevent production shutdowns.

Sometimes the nature of the problem quickly cascades into other types of problems and a number of such verbal alarms are present almost instantaneously. Interlocks may be provided to prevent none but the first alarm condition to be annunciated. However, although this technique prevents the confusion attendant with more than one verbal message annunciating at the same time, the information relating to the nature of subsequent alarms is lost.

DISCLOSURE OF INVENTION

The object of the present invention is to provide apparatus for alarming a plurality of sensed parameters relating to a magnet wire fabrication process.

According to the present invention, a process alarm system is responsive to a plurality of sensors which provide binary, digital, on-off, or two-state signals indicative of either a normal or abnormal process condition. A plurality of modular cassette tape players, each responsive to one of the binary signals from the plurality of sensors provides individualized verbal message signals in response to the presence of a two-state (binary) signal in a state indicative of an abnormal process condition. A public address (PA) system is responsive to the individualized verbal message signals for announcing individualized verbal messages to maintenance personnel. According further to the present invention, a local operator control & monitoring station is provided for controlling, monitoring and alarming a magnet wire fabrication process by means of a remote controller located out-of-the-way of the process so as to permit maximum effective usage of the floor space in a magnet wire fabrication facility. The modular cassette players, along with their associated circuitry may be located in the remote controller. In any case, the control & monitoring station is responsive to the same plurality of sensors as the alarm system. The operator locally controls and monitors the fabrication process by means of the local control & monitoring station which has a local signal processor, a keyboard and a display therein. The local signal processor is responsive to operator inputs received via the keyboard. With regard to monitoring functions, the operator will input screen request signals for calling up any of a plurality of screens, including a test screen and a screen for listing listing alarms in the order in which they occurred, for displaying alarm status for various parameters. The signal processor in conjunction with the annunciator system will conduct a test or will output actual alarms on the appropriate screen in the order of occurrence. The signal processor may do this by storing and time tagging alarm signals as they come in for later call-up and ordering, if required. Time tag signals, indicative of the time received, are stored along with each incoming alarm signal and can be easily compared for sequentially ordering the associated alarm signals.

Another way of time ordering incoming alarms is to place them sequentially in a register stack such as a first-in-first-out (FIFO) having a selected number of registers. Assuming a reset signal has been input by the operator, all the registers are cleared and ready to receive and store the identities of incoming alarm signals. The identity of the first incoming alarm signal is stored in the first register, the second incoming signal in the second register, and so on until all the registers are filled. Any additional incoming alarm signals received before the next operator initiated reset signal is received are ignored. In this way, it is unnecessary to actually time tag each signal, as they are time ordered automatically.

One of the alarm screens produces a display which lists each alarm condition in the order in which it was received. Thus, if a verbal annunciation of more than one alarm occurs at roughly the same time, the operator may later wish to determine which one occurred first, and he can then go back to the operator control station and call-up the alarm sequence screen to display the order in which the alarms occurred. This will be useful to the operator or to maintenance personnel in troubleshooting a system which has shutdown for a cause which may not be readily apparent.

The remote controller digital I/O device is responsive to a plurality of sensed digital signals at a first input thereof. It provides the sensed digital signals as a corresponding plurality of digital signals to the remote signal processor for storage and time tagging. The digital I/O device is also responsive, at a second input thereof, to at least one returned sensed digital signal from the remote signal processor for providing such at an output thereof for alarming one or more parameters by means of the annunciator hardware which may be located externally or in the remote controller itself, if desired.

It also is highly desirable to have an alarm system for a magnet wire fabrication process with a small local operator station that can be located close to the process and convenient for the operator. This station, if connected to a remote controller which is located out-of-the-way of the process, with a small multiconductor cable, gives the operator easy accessibility for monitoring all parameters. Further, this system may be set up to automatically monitor all controls and safety devices and notify the operator of any failures as the occur, in the order in which they occur. Finally, the system can be set up to automatically record all alarm conditions at any time. This historical information can be very useful for quality control purposes, as well as for gaining a better understanding of the process.

The alarm system of the present invention is effective in lowering the scrap rate and downtime of wire manufacturing processes by providing immediate verbal annunciation of the source of a problem which may be quickly corrected before causing a production shutdown. The use of cassette tape recorders, easily available off-the-shelf at low cost, provides an extremely inexpensive method of providing such a verbal annunciator system as compared to present date digital methods. The costs expended are also less than would be expended in a dedicated signal tape multichannel tape recorded type system. The modularity of the cassette player provides a highly desirable means of easy recorder problem correction by simply replacing the modular cassette player if a problem develops. In addition to the above advantages, the claimed combination of such a verbal annunciator with means for recording and time tagging alarm signals as they occur for later call-up by an operator for determining the order in which such alarms occurred provides a highly effective troubleshooting tool with which sometimes difficult problems can be quickly pinpointed.

These and other objects, features and advantages of the present invention will become more apparent in light of the following detailed description of a best mode embodiment thereof, as illustrated in the accompanying/drawing.

BRIEF DESCRIPTION OF THE DRAWING

FIGS. 4–5 are illustrations of display screens, such as may be provided on the display of the local operator control station;

BEST MODE FOR CARRYING OUT THE INVENTION

Figure 1:
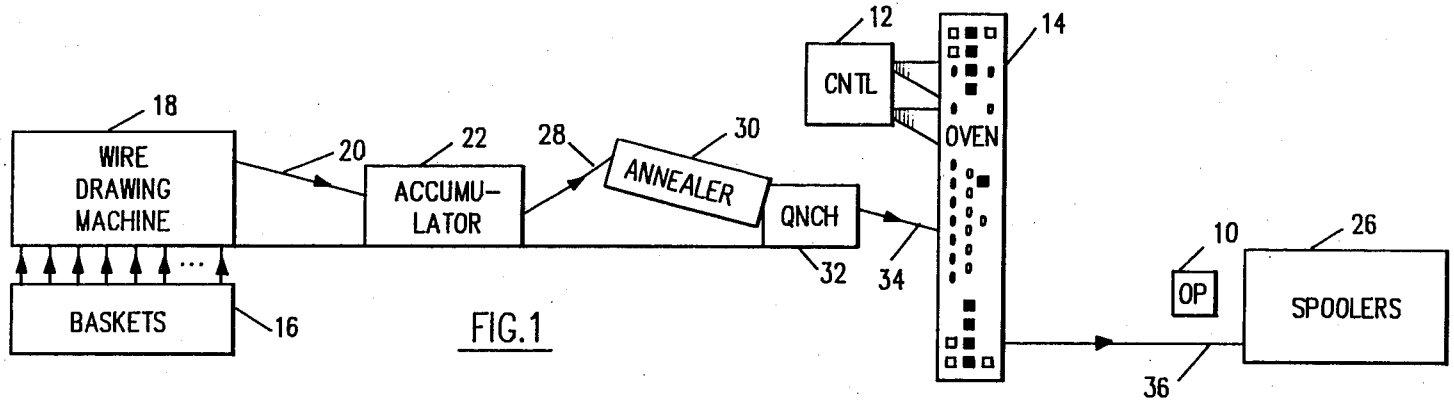
FIG. 1 is an illustration of a wire drawing apparatus in-line with an enameling process.

FIG. 1 is an illustration (not to scale) of an in-line wire drawing process for fabrication of magnet wire. Included within the FIG. 1 is a local operator control & monitoring station 10 for controlling and monitoring the process by means of a remote controller 12 to which it is also connected to a plurality of controlled units within a curing oven 14. These may, for example, include nine burners symbolized by darkened squares, six variable speed fans symbolized by light colored squares, eighteen controlled dampers symbolized by circles and an array of safety interlocks (not shown). The actual control format for controlling the various controlled units will not be described in detail as such does not involve the invention.

The remote controller 12 is also connected to a plurality of sensors such as, without limitation, those disclosed in U.S. Pat. No. 4,644,332. These include such sensors as wire runtogether, tangle, and dry lube level, among others. The remote controller may also include external, stand along hardware and circuitry for annunciating verbal messages, i.e., cassette tape players, relays, lamps, switches, etc. In that way, a standalone independent alarm station may be avoided and incorporated within the remote controller disclosed herein.

Heavy gauge wires are provided from a plurality of wire baskets 16. The wires are pulled up out of the baskets into a wire drawing machine 18 which draws the wire down to a smaller gauge and provides a plurality of smaller gauge wires on a plurality of lines 20 to an accumulator 22.

Since a large plant will have a very large number of fabrication lines in operation simultaneously, such a large number of drawing machines will draw a considerable amount of electrical power, and there can often be no economical provision of in-house electrical power for these machines. Therefore, they are normally fed from the utility grid. As such, they are subject to voltage fluctuations on the power grid, which occur from time to time. On the other hand, the spooling process, or takeup of wire onto a plurality of spools, as shown by spoolers 26, is driven by means of an in-house electrical power source, not subject to the normal voltage fluctuations present on the utility power grid. It is necessary to feed the spoolers' capstan with in-house power because of the criticality of the enameling and baking process, particularly for high speed wire fabrication processes. With the wire drawing machine fed by a power source which is subject to voltage dips, and hence slowdown, and the spoolers' capstan still pulling at full speed during such a voltage dip, the wires will break if the accumulator 22 does not have sufficient wire slack available to provide accumulated wire to the capstan during the usually brief drawing machine slowdown.

Wire 28 leaving the accumulator enters an annealer 30 which heats the wire and suddenly cools the wire in a quencher 32 at the exit thereof.

Wire 34 leaving the quencher enters the oven 14 where it is dipped in liquid enamel, baked, redipped and rebaked repeatedly until the desired electrical and mechanical properties have been provided At that point, wires 36 are provided to the spoolers 26 and wire is spooled on spools therein.

Figure 2:
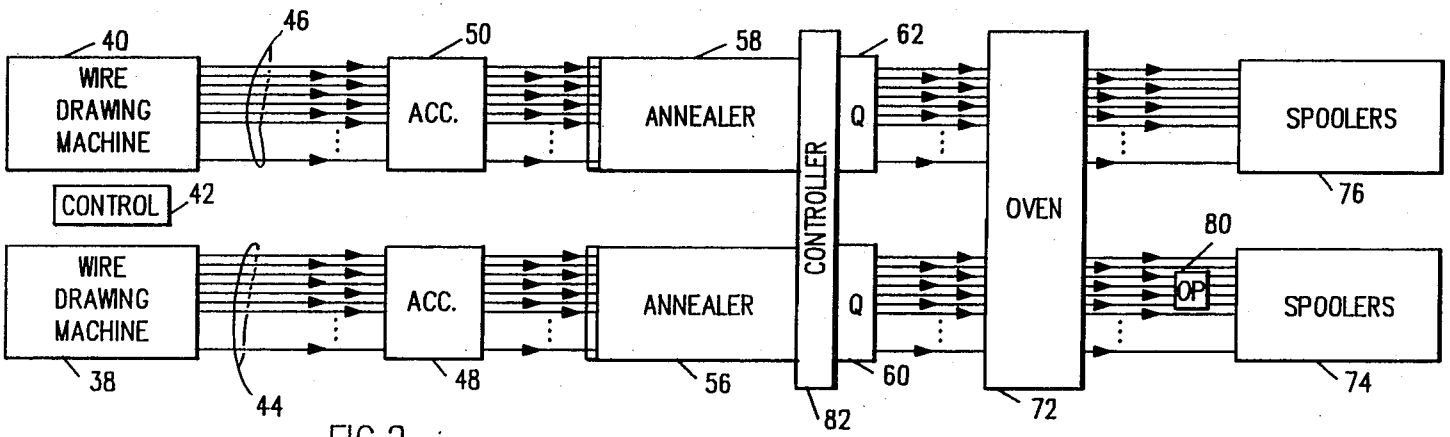
FIG. 2 is a top view of two wire fabrication lines similar to the line shown in FIG. 1 except as viewed from above.

FIG. 2 is an illustration showing a a pair of in-line wire drawing machines 38, 40 similar to that of FIG. 1 except viewed from above. A control 42 includes a plurality of variable speed drive controllers for controlling a plurality of variable speed motors in the drawing machines 38, 40. The drawing control 42 is, for the purpose of this disclosure, separate from an oven control (similar to the control 10, 12 of FIG. 1) to be described below and can be designed to provide independent drawing control. However, it will be understood that the drawing and spooling processes can be made interdependent.

It will also be understood that in a large magnet wire fabrication plant there will be dozens of such in-line drawing-annealing-enameling processes for fabricating magnet wire. To achieve maximum efficient use of floor space in such a factory each fabrication line will be in parallel with and as close to the other fabrication lines as possible. Therefore, the two in-line processes pictured in FIG. 2 should be thought of as only two in-line processes among a large plurality of such in-line processes all adjacent to one another in parallel and filling up a factory floor.

A plurality of small gauge wires 44 emerge from wire drawing machine 38 and a plurality of wires 46 similarly emerge from machine 40. Accumulators 48, 50 receive the two groups of wires 44, 46, respectively, and in turn provide the wires to a pair of annealers 56, 58 including quenchers 60, 62. The wire is then provided to an oven 72 where the wires are dipped, baked, and redipped and rebaked repeatedly until emerging for spooling on spoolers 74, 76. The process is controlled and monitored by means of a local operator control & monitoring station 80 which is convenient to the operator and which, in turn, controls and monitors the various components and sensors by means of a remote controller 82 which is raised up above the annealers 56, 58, for example, on a catwalk, as is similarly shown in FIG. 1 for controller 12.

Figure 3:
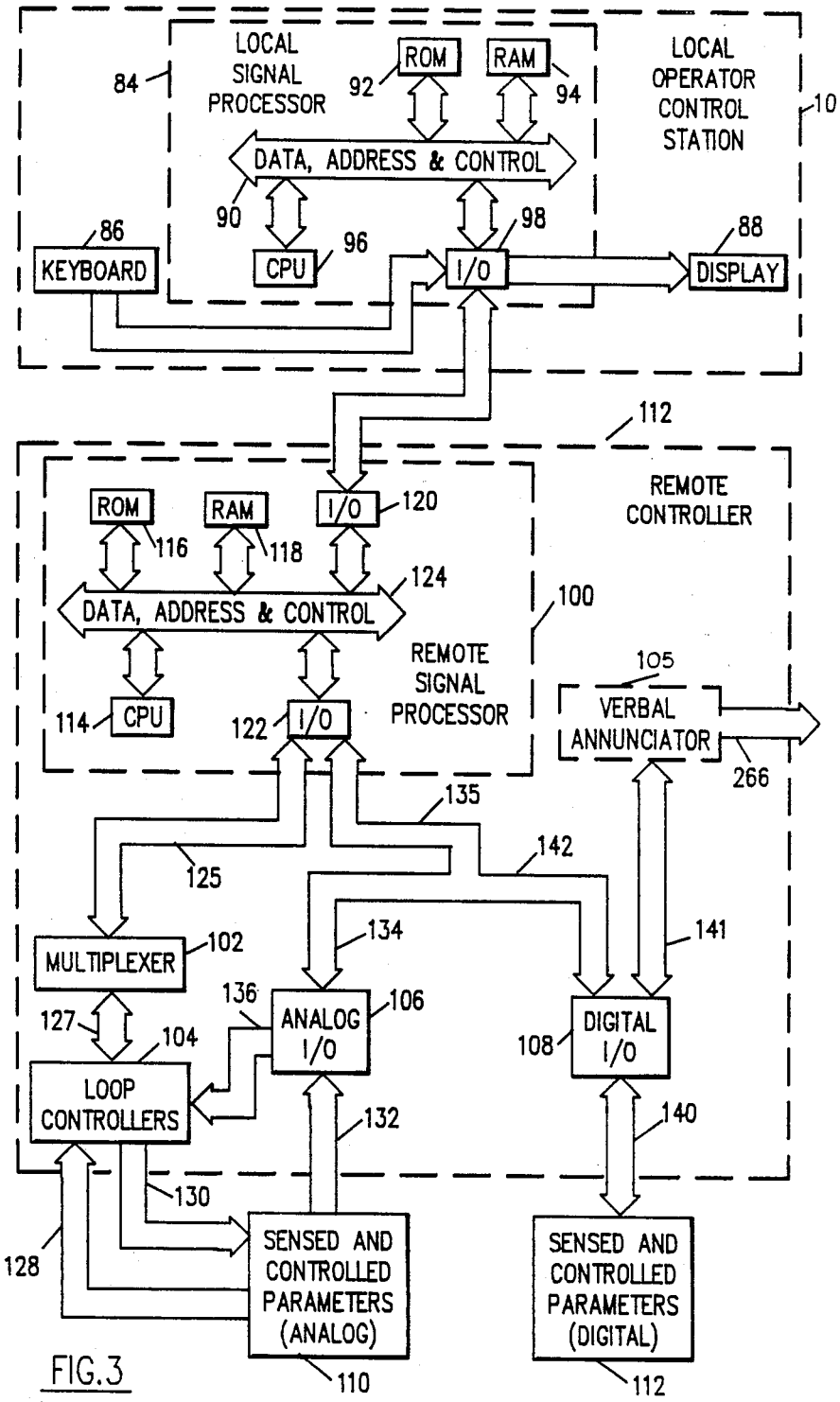
FIG. 3 is a simplified block diagram illustration of a local operator control station used for controlling and monitoring a wire fabrication process such as that of, FIGS. 1 and 2, by means of a remote controller, according to the present invention.

FIG. 3 is an illustration of the local operator control station 10 of FIG. 1 which is shown interconnected to the remote controller 12, also of FIG. 1.

The local operator station 10 includes a local signal processor 84, a keyboard 86 and a display 88. The operator station may be a Nematron IWS 1503. Such a self-contained unit consists of a CRT display screen, a 34 key touch pad and a dedicated processor all mounted in an industrial enclosure. User created screens such as those to be briefly described by way of example in FIGS. 4–5 can be stored in the Nematron's memory. Screens may be created by the designer to allow the operator to start and stop fan motors and burners, set temperatures, control dampers, and observe all necessary process functions. In addition, there may be screens provided to control and monitor the fault alarms and record and display faults in the order in which they occur. The recording, time tagging and ordering function may also be equivalently carried out in the remote controller. To record data on a hard copy the design may provide screens that give instructions for connecting a printer and provide for the dumping of memory onto a hard copy. The operator station can be mounted as shown in FIG. 1 near the operator's work area and connected to the remote controller 12 via a small four conductor cable.

The local signal processor 84 shown in FIG. 3 includes a data, address and control bus 90, a read only memory (ROM) 92, a random access memory (RAM) 94, a central processing unit (CPU) 96 and an input/output (I/O) port 98. This may be thought of as the dedicated processor provided by the Nematron manufacturer or may be thought of as an off-the-shelf general purpose signal processor. For such a processor, the ROM would be used to stored the screens while the RAM would be used to store sensed signal values, intermediate values and setpoints, for example. The CPU is used for manipulating signal values and may also be used for performing calculations. The I/O port is used for receiving inputs from the keyboard, for providing and receiving signals to and from the remote controller 12 and for displaying the screens stored in ROM and the setpoints, sensed values, etc., relating thereto.

The remote controller 12 includes a remote signal processor 100, a multiplexer 102, a plurality of loop controllers 104, a verbal annunciator 105 and may also include a plurality of analog input/output (I/O) units 106 and another plurality of digital I/O units 108. It will be understood that the multiplexer, loop controllers and analog I/O units perform control functions only and form no part of the present invention. On the other hand, the digital I/O unit 108 may serve monitoring and alarm functions as well as control functions.

The monitoring and alarm function of the remote controller 12 includes receiving sensed signals over lines 140 from the various alarm condition sensors such as runtogether, tangle, level, etc., sensors and providing alarm signals over these same lines 140 to an external verbal annunciator or internally via lines 141 to internal verbal annunciator 105 incorporating cassette players, relays, etc.

FIG. 3 contains a block 110 symbolizing the analog sensed parameters which are controlled by the remote controller 12. FIG. 3 also includes a block 112 symbolizing a plurality of digitally sensed, monitored, alarmed and controlled parameters.

The remote signal process 100 of FIG. 3 is illustrated as having a CPU 114, a ROM 116, a RAM 118, and I/O units 120, 122, all communicating with a data, address and control bus 124. The remote signal processor 100 may be thought of as a general purpose signal processor having a program stored in its ROM and which is responsive to setpoint and monitoring request signals from the operator control station for conditioning the setpoints, for providing conditioned versions thereof and for performing monitoring functions with signals at the output ports 120, 122 thereof on lines **125, 125*a*. Furthermore, the remote signal processor may be used to provide multiplexer channel select signals at the output port 122 for controlling the multiplexer 102**.

The multiplexer is of course responsive to such a signal on line 125 and routes the conditioned setpoint signals to the proper loop controllers 104 on a line 127.

The loop controllers are each responsive to a selected one of the conditioned setpoint signals provided on the various selected output channels of the multiplexer. The loop controllers are also responsive to the sensed analog signals 110 on a line 128 and compare the magnitudes of those sensed signals to the magnitudes of the setpoint signals and in turn provide control signals on a control line 130 back to the controlled parameters which may be controlled by analog devices.

It is sometimes necessary to take in a number of analog sensed signals and condition those signals to come out with a single result which may be a function of the plurality of sensed signals. In such cases, it is necessary to take in a plurality of such sensed signals on a signal line 132 which are provided to the analog I/O unit 106 for provision over a signal line 134 to the remote signal processor 100 on a line 135. There, the plurality of signals provided on 132 are conditioned according to a functional relationship and a single output signal is provided back to the analog I/O unit 106 via signal lines 135, 134 from the remote signal processor 100. This single signal is then provided over a signal line 136 to a loop controller and is used therein as a sensed signal to be compared with a setpoint signal received from the local operator control station over line 127. This results in a control signal over signal line 130 to an analog device for controlling a controlled parameter.

It will be understood by those skilled in the art that it is sometimes necessary to digitally sense controlled parameters such as those pictured symbolically in block 112 by means, for example, of the digital I/O unit 108 pictured in the remote controller 12 of FIG. 3. Such signals are typically simply "on-off" type signals such as alarm contacts and may be sampled over a signal line 140 and provided to the remote signal processor 100 via a signal line 142 and signal line 135 for conditioning. After conditioning, or even after simple "pass-through" a control or alarm signal can be provided by the remote signal processor back over signal line 135, 142 to the digital I/O unit 108 for being output over siqnal line 140 to the controlled parameter or to the annunciator via line 141. As mentioned, the annunciator may be located internal to the remote controller, in which case there is no need for routing the alarm output externally. The alarms can also be routed directly into the annunciator from either the outside of the remote controller or via the digital I/O unit 108.

A printer (not shown) can be connected to the operator control station 10 to generate a hard copy historical record of parameters and alarms.

The digital I/O units may comprise Square D 8030 DIM 101 units and 8030 DOM 221 units. A typical application may include, for example, thirty-two digital inputs and nine digital outputs.

Referring now to FIG. 4, an illustration is there provided of an alarm control screen for a magnet wire fabrication process which is displayed on a typical display screen for a typical local operator control station. If the operator control station is a Nematron IWS 1503 there will be a horizontal array of push buttons under the screen. Any function may be assigned to an particular push button and two of such functions (test & exit) have been selected for the push buttons selected in FIG. 4. For example, by pressing the test push button (not shown) located directly under the "TEST ALRM" box on the screen, the operator can then press one of the buttons F1–13 to learn if the channel is working and can then silence the alarm by pressing it again. As indicated on the screen, he can press F14 to get a screen illustrated in FIG. 5 (after one or more alarms occur, in order to find out the failure sequence, i.e., in what order the alarm conditions occurred) which is self-explanatory.

Figure 6:
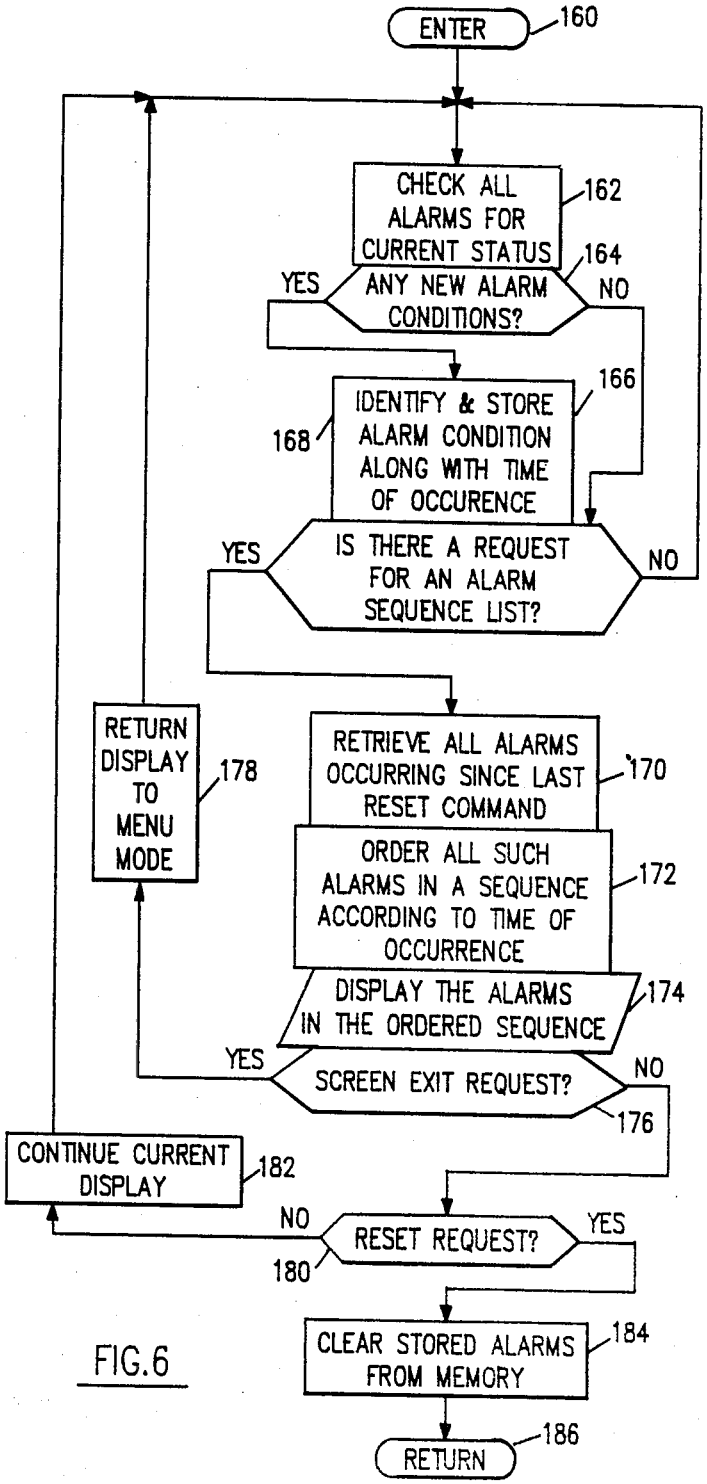
FIG. 6 is a simplified flowchart illustration of a sequence of logical steps which may be carried out by the signal processor of FIG. 3.

FIG. 6 is a simplified flowchart illustration of a series of logical steps which may be carried out by either the local signal processor 84 or the remote signal processor 100 of FIG. 3. In fact, the tasks outlines in FIG. 6 may be shared by the two processors and the choice of which processor carries which task is not relevant as these tasks can be traded off according to design choice.

After entering at a step 160, a step 162 is next executed in which all alarms are checked for current status, i.e., "current" meaning since the last reset request (where all prior alarms are cleared). If there are any new alarm conditions detected in a step 164 a step 166 identifies and stores the new alarm condition along, in some embodiments, with the time of occurrence. The alarm signal can be instead be stored in the first register of a plurality of registers such as a FIFO. Subsequent alarms can be stored in the second, third, etc., registers until all available registers are filled up. At that point no additional alarm signals will be stored unless a reset request signal is received, at which point the registers will one again be made available for storage, as before. In this way alarms can be received and automatically time-ordered without having to time-tag the signals.

A step 168 is next executed in which a determination is made as to whether or not a request for an alarm sequence list has been made by the operator. This step 168 would have been entered directly from step 164 if no new alarm conditions had been detected. If there is no request for an alarm sequence list a return is made to step 162 and the entire sequence of steps 162, 164, 166, 168 are repeated until there is a request for an alarm sequence list.

If a determination is made in step 168 that there is a request for an alarm sequence list, a step 170 is next executed in which all alarms occurring since receiving the last reset command are retrieved and displayed. If not ordered by means of FIFO, the time-tagged signals must be ordered in a step 172 in a sequence according to the time of occurrence. Whether FIFO ordered or time-tag ordered the alarms are then provided to the display in the ordered sequence in a format such that they are displayed in that ordered sequence. A determination is next made in a step 176 as to whether or not a screen exit request has been made. If so, the display is returned to the menu mode in a step 178 and step 162, et seq., is repeated. If not, a determination is made in a step 180 as to whether or not a reset request has been received or not. If not, the current display is continued, as indicated in a step 182 and step 162 et seq. is repeated. If a determination is made in step 180 that a reset request has in fact been made by the operator a step 184 is next executed in which all alarms currently stored in memory are cleared and a return is then made in a step 186.

Figure 7:
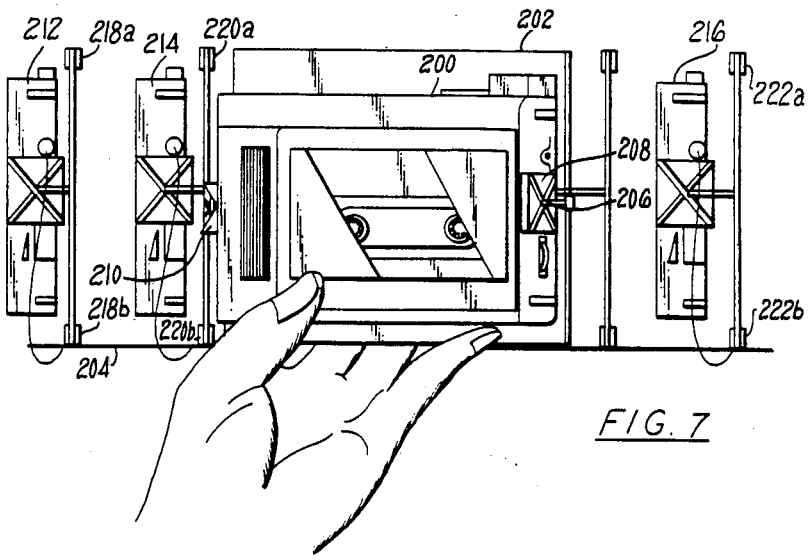
FIG. 7 is an illustration of a cassette tape player mounted on a plate and removed by hand from its installation mount.

FIG. 7 shows a cassette player 200 and a plate 202 removed from a rack 204 for inspection. The cassette player 200 is attached to the plate by means of a tie-wrap 206 attached at each end of the cassette player by anchors 208, 210. The tie-wrap is used to tightly bind the cassette player to the plate by wrapping the tie-wrap behind the plate 202 of FIG. 7.

A number of similar modular cassette players 212, 214 . . . 216 are shown mounted, respectively, upon slide mounts **218*a* & 218*b*, 220*a* & 220*b* . . . 222*a* & 222*b*. The rack with mounts and cassette players can be mounted within the remote controller 12 of FIG. 3 within the rack 204 which may be the same as enclosure 141*a* of FIG. 3**. Of course, the rack can be within a separate enclosure within the remote controller, if desired.

Figure 8:
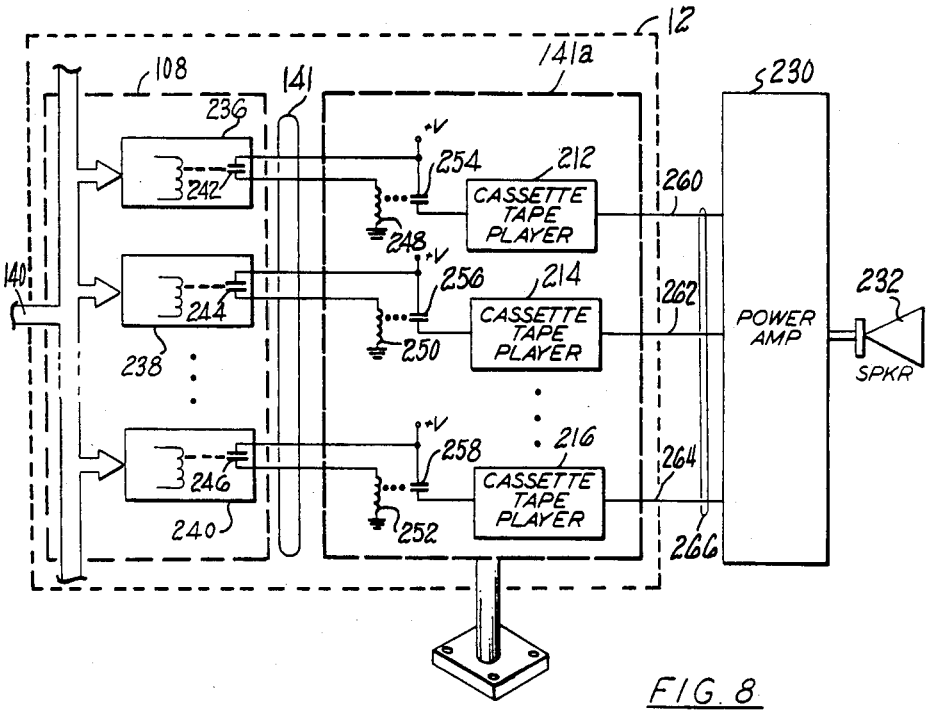
FIG. 8 is a simplified schematic block diagram illustration of a verbal alarm annunciator system, such as that shown in FIG. 3.

A simplified schematic block diagram illustration of the manner in which the cassette tape players 212, 214 . . . 216 are connected within the remote controller 12 of FIG. 3 to the digital I/O unit 108 and to an external power amplifier 230 with speaker 232 is shown. There, a plurality of digitally sensed parameters 112, such as is illustrated in FIG. 3, provide signals on the plurality of lines 140 to individual digital I/O units within the digital I/O unit 108 of FIG. 3. Each digitally sensed parameter may be conceptually visualized as providing a contact closure for abnormal conditions over the signal lines 140. Such contact closure can be thought of as energizing a coil shown within each of a plurality of individual I/O units 236, 238, . . . 240 which in turn cause an additional associated contact closure 242, 244, . . . 246. The closing of contacts 242, 244, . . . 246 will provide voltage to respective relay coils 248, 250 . . . 252 which act to close associated contacts 254, 256, . . . 258 to effect energization of the cassette tape players 212, 214, . . . 216, respectively, as appropriate. Of course, it will be understood that the illustration of FIG. 8 is merely presented in simplified form for illustrative purposes and that therefore the conceptualized switches, relay coils, etc., are merely illustrative and may be replaced with other types of switches, contacts, control circuits, etc., such as transistor switches, digital logic, etc. Each of the cassette tape players 212, 214, . . . 216, when appropriate, will provide abnormal message signals on lines 260, 262, 264 which may together be represented by a single signal line 266 as also shown in FIG. 3 to the power amplifier 230 and the speaker 232 of FIG. 8.

Figure 9:
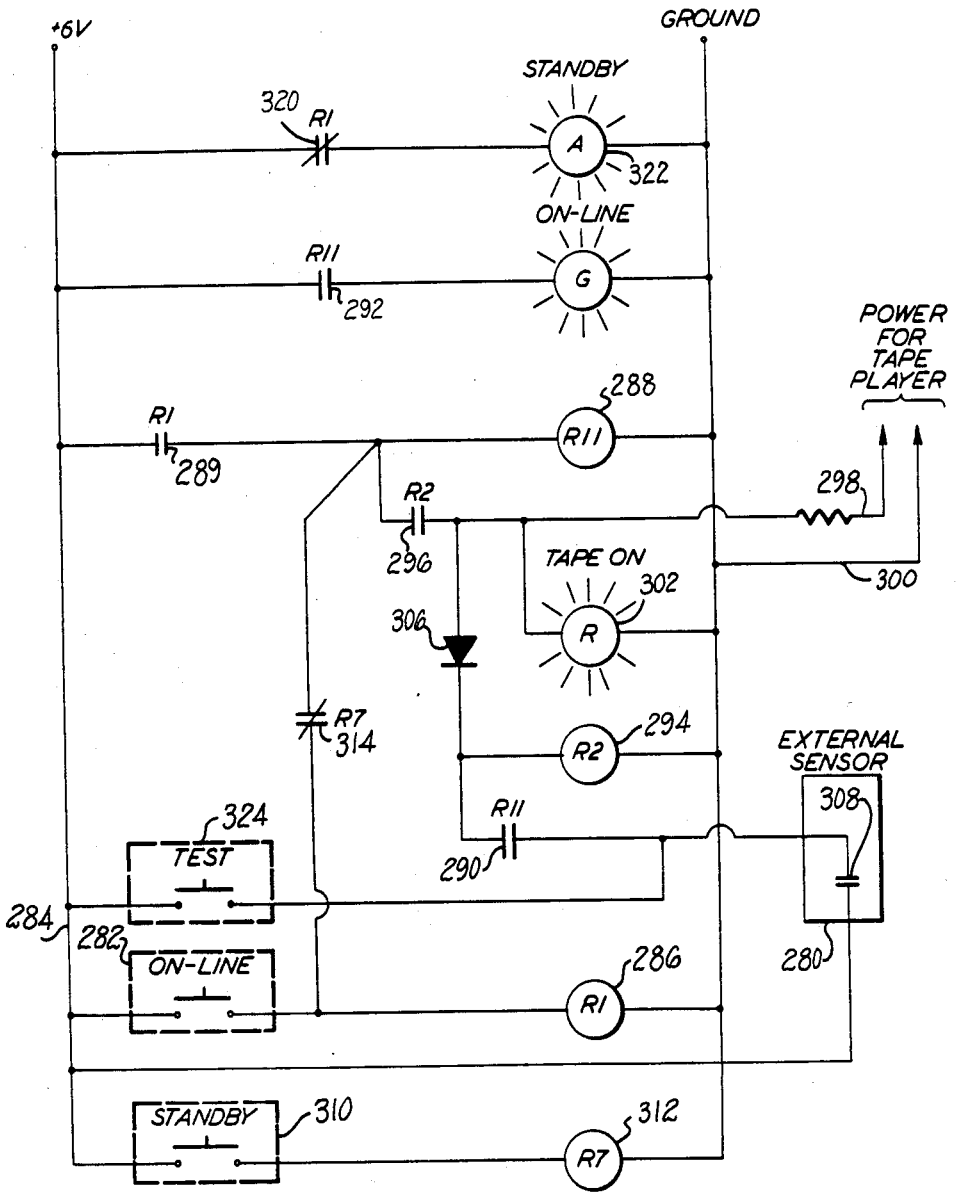
FIG. 9 is a simplified schematic diagram showing one way in which a verbal alarm announcement channel maybe designed.

FIG. 9 is a control circuit for a verbal annunciator such as the remote controller of FIG. 3 for controlling the power to a cassette tape player. For example, an external sensor 280, such as a runtogether sensor, provides a contact closure to the control circuit for actuating the tape player by means of providing power to the drive motor in the player.

The operation of the circuit of FIG. 9 can be described briefly as follows: an ON-LINE switch 282 may be actuated to provide 6 VDC on a line 284 to energize a pair of relay coils 286, 288. The energization of coil 286 causes normally opened contacts 290, 292 to close. A green on-line lamp is thereby energized and a path for energizing a coil 294 is partially made. If the external sensor 280 is subsequently made as well, then the path is completely made, coil 294 will be energized, a normally opened contact 296 will close and power for the tape player will be supplied to the tape player's drive motor on a pair of lines 298, 300. A read TAPE-ON lamp 302 is also energized by the closing of contact 296. The tape player will then begin to provide an alarm message output signal to the power amplifier 230 and speaker 232 of FIG. 8. A diode 306 permits the message to continue even if a sensor switch 308 reopens. Maintenance personnel will then respond to the verbal announcement and may silence the verbal message by actuating a STANDBY switch 310 which causes a relay coil 312 to become energized, which in turn causes a normally closed contact 314 to open, thereby deenergizing coil 286 and opening contact 289. This causes coil 288 to become deenergized and contact 290 to open thereby deenergizing coil 294 and opening contact 296 which removes power from the tape player and causes the red light 302 to go out. A normally closed contact 320 will then close and an amber STANDBY lamp 322 will then go on to indicate on the panel 12 that the channel is in a standby or silence condition undergoing maintenance. Of course, it will be understood that the lamps may be replaced by coils, for example, and may cause additional contacts to close which signals may be sent to the remote signal processor 100 of FIG. 3 for display on the local operator control station display 88.

If, during normal ON-LINE operation, an operator wishes to test the verbal annunciator for this particular channel at the local operator control station, he may actuate a test push button which, is symbolized by a push button switch 324, but which would, in reality, be located on the local operator control station 10 of FIG. 3; this switch acts in substitution for the external sensor 280 to energize coil 294 which causes power to be applied to the tape player through contact 296 for as long as the test switch is pressed in.

It will also be understood that the relay logic of FIG. 9 can easily be replaced by a signal processor programmed to perform the same or similar functions using a sequence of logical steps. In fact, the Nematron control station mentioned previously is typically supplied with such programs, for example, programmable by the user in ladder logic such as is shown in FIG. 9 but without the relay logic, lamps and other components.

Of course, the circuit of FIG. 9 is replicated for each channel shown in FIG. 8. Each of the other channels of FIG. 8 will have a similar circuit for accomplishing the same purpose. It will also be understood that the illustration of FIG. 9 is still in somewhat simplified form in that additional circuitry may be added to increase the sophistication of the circuit to provide, e.g., interlocks for defeating annunciations after a first to occur alarm, and other elaborations.

Although the invention has been shown and described with respect to a best mode embodiment thereof, it should be understood by those skilled in the art that the foregoing and various other changes, omissions, and additions in the form and detail thereof maybe made therein without departing from the spirit and scope of the invention.

We claim:

1. Apparatus for monitoring a plurality of sensed parameters relative to a magnet wire fabrication process, comprising:

an operator control station for locally monitoring the process, having a local signal processor, a keyboard and a display, said local signal processor responsive to operator input signals received via said keyboard for providing display format signals at an output of said signal processor for displaying screens on said display in a selected format; and a digital input/output I/O device, responsive to a plurality of sensed digital signals at a first input thereof for providing said sensed digital signals at an output thereof;

a plurality of cassette tape players, each responsive to one of said sensed digital signals from said digital I/O device, for providing individualized verbal message signals in response to the presence of a sensed digital signal in a state indicative of an abnormal process condition; and a remote signal processor; responsive to said sensed digital signals provided at said digital I/O device output for storing each of said sensed digital signals and for storing, for each of said digital signals, an associated time tag signal indicative of the time received, and for providing each of said stored digital signals along with each's associated time tag signal at an output thereof;

said local signal processor, responsive to an operator input signal indicative of a request for a display of alarms in the order in which they occurred and responsive to said stored digital signals along with said associated time tag signals, for ordering said stored digital signals in a time sequence beginning with the earliest associated time tag signal and continuing with the next earliest, and so on, until ending with the last time tag signal, and for providing alarm order display format signals and said ordered digital signals to said display for display thereof in said selected format in said ordered time sequence.

* * * * *

UNITED STATES PATENT AND TRADEMARK OFFICE

CERTIFICATE OF CORRECTION

PATENT NO. : 4,808,971

DATED : February 28, 1989

INVENTOR(S) : Randall C. Graham et al

It is certified that error appears in the above-identified patent and that said Letters Patent is hereby corrected as shown below:

Col. 1, line 34 "by only by" should be -- only by --.

Col. 1, line 35 "and" should be -- an --.

Col. 3, line 8 "the" , second occurrence, should be -- they --.

Col. 4, line 23 "along" should be -- alone --.

Col. 7, line 44 "an" should be -- any --.

Col. 8, line 9 "one" should be -- once --.

Col. 9, line 38 "read" should be -- red --.

Col. 10, Claim 1, line 36 after "and" should be inserted -- a remote controller, comprising: --.

Signed and Sealed this

Twelfth Day of September, 1989

*Attest:*

*Attesting Officer*

DONALD J. QUIGG

*Commissioner of Patents and Trademarks*